US010314382B1

(12) United States Patent
Riedel et al.

(10) Patent No.: US 10,314,382 B1
(45) Date of Patent: Jun. 11, 2019

(54) SUPPORT HARNESS

(71) Applicants: Joshua D. Riedel, Fort Worth, TX (US); Robin C. Putman, Crowley, TX (US); Joseph D. Preston, Fort Worth, TX (US); Stacy Harris-Riedel, Fort Worth, TX (US)

(72) Inventors: Joshua D. Riedel, Fort Worth, TX (US); Robin C. Putman, Crowley, TX (US); Joseph D. Preston, Fort Worth, TX (US); Stacy Harris-Riedel, Fort Worth, TX (US)

( * ) Notice: Subject to any disclaimer, the term of this patent is extended or adjusted under 35 U.S.C. 154(b) by 133 days.

(21) Appl. No.: 15/175,889

(22) Filed: Jun. 7, 2016

Related U.S. Application Data

(63) Continuation of application No. 12/209,506, filed on Sep. 12, 2008, now abandoned.

(60) Provisional application No. 60/994,132, filed on Sep. 17, 2007, provisional application No. 61/073,494, filed on Jun. 18, 2008.

(51) Int. Cl.
*A45F 3/00* (2006.01)
*A45F 3/14* (2006.01)
*A41F 9/00* (2006.01)

(52) U.S. Cl.
CPC ..... *A45F 3/14* (2013.01); *A41F 9/002* (2013.01); *A45F 2003/146* (2013.01)

(58) Field of Classification Search
CPC .. A45F 3/14; A45F 3/142; A45F 3/144; A45F 2003/146; A41F 9/002
See application file for complete search history.

(56) References Cited

U.S. PATENT DOCUMENTS 733,776 A * 7/1903 Warner ..... A41D 1/04 2/115
1,787,216 A * 12/1930 Spielberger ..... A41D 1/04 2/102
2,308,278 A * 1/1943 Gluckmann ..... A41F 3/02 2/117
2,315,698 A * 4/1943 Gluckmann ..... A41F 3/02 2/117
4,982,885 A * 1/1991 Severson ..... A45C 13/30 224/250
5,345,633 A * 9/1994 Harnish ..... B60N 2/4879 224/579
5,509,591 A * 4/1996 Carver ..... F41C 33/0227 224/222
5,623,735 A * 4/1997 Perry ..... A41F 3/00 2/326
5,865,357 A * 2/1999 Goodwin ..... A45F 5/02 224/587
6,698,031 B2 * 3/2004 Lewis ..... A41D 13/00 2/340

(Continued)

*Primary Examiner* — Khaled Annis
(74) *Attorney, Agent, or Firm* — Groover & Associates PLLC; Robert O. Groover, III; Gwendolyn G. Corcoran

(57) ABSTRACT

A support system with attachments configured to connect to an equipment belt, such as a utility or gun belt, but worn under exterior clothing. In an exemplary embodiment, the support system is worn beneath the clothing, but connects to exterior equipment, without requiring modification of the clothing. A formed joining area between a semi-flexible downward extension and upper extension accommodates a tucked shirt while attaching to an exterior equipment belt at approximate waist level.

14 Claims, 8 Drawing Sheets

(56) References Cited

U.S. PATENT DOCUMENTS

| | | | | |
|---|---|---|---|---|
| 6,804,834 | B1 * | 10/2004 | Mok | A41F 3/00 2/329 |
| D581,633 | S * | 12/2008 | Seibold | D2/841 |
| 7,891,023 | B1 * | 2/2011 | Hill | A41B 1/08 2/305 |
| 2003/0102346 | A1 * | 6/2003 | Chen | A45F 3/14 224/675 |

* cited by examiner

SUPPORT HARNESS

CROSS REFERENCE TO RELATED APPLICATIONS

This application claims priority from provisional patent applications 60/994,132, filed on Sep. 17, 2007 and 61/073,494 filed on Jun. 18, 2008, both of which are hereby incorporated by reference.

FIELD OF THE INVENTION

The present application relates to a worn equipment support apparatus, and more particularly to an equipment belt for supporting equipment with added support from a supplemental support system.

BACKGROUND OF THE INVENTION

Equipment belts worn in some occupations (such as law enforcement) often carry several pounds of gear. For example, a typical equipment belt worn by a police officer will include several attached items, including a gun, holster, hand cuffs, spare magazines, flashlight, Taser®, pepper spray, radio, baton, and other items. The collective weight can easily exceed 20 to 30 pounds. This weight, when worn on the hips in the usual manner, can cause inflammation of the sacroiliac joint, which is located at the bottom of the back, on either side of the spine.

Some prior art methods of alleviating this burden focused on redistributing the weight, for example, by providing attachments to clothing or materials that are worn over the shoulder. For example, suspenders can be attached to a belt to help carry the burden on the shoulders rather than entirely on the hips. This also helps redistribute some of the weight from the hips to the shoulders.

However, in prior art systems, the location of the harness or attachments can create other problems. Typically, law enforcement uniform and safety standards forbid an external suspension system. For example, if a harness is worn outside the clothing to alleviate weight on an equipment belt, the harness is exposed, which is subject to snagging on objects, providing a "handle" on the wearer, or in some other way violating department uniform standards. Under some circumstances, this can be extremely disadvantageous and pose safety issues, such as when the wearer must navigate tight spaces where the torso may rub against other objects (creating the snagging hazard). In law enforcement, where the wearer may be required to engage in a physical altercation (creating the "handle" hazard), an exposed suspension system can present a considerable safety issue, by giving an adversary a convenient grip having considerable leverage, potentially putting the wearer in danger in a physical fight while attempting to subdue and arrest a suspect. Law enforcement personnel widely refer to such an exposed suspension system as "suicide straps."

Additionally, because the equipment belt is designed for wearing outside the clothing, prior art support harnesses cannot easily be worn beneath the clothing. This generally is possible only if the clothing itself were modified to allow an interior support harness to pass through the clothing at a strategic point (such as using a hole cut into the clothing) to connect the interior harness to the exterior equipment belt. In cases where a protective vest or other protective garment is worn beneath clothing, integrating a support and connecting the interior vest support with the exterior equipment belt would require holes or other pass-through means, which could compromise protection.

Thus, there is a need for a way to alleviate discomfort arising from heavy equipment belts by providing additional support that can preferably be worn beneath the clothing to avoid the hazards mentioned above, meet safety standards, and comply with uniform standards.

In an exemplary embodiment, the present innovations include a support system with attachments configured to connect to an equipment belt, such as a utility or gun belt. In other embodiments, the innovations are characterized by a harness (or other item suspension or weight distribution means, such as suspenders) that attaches to an equipment belt. The suspension system includes attachments that connect to the equipment belt, but which also allow the system to be worn beneath the clothing (such as beneath a uniform) without modification of the clothing. The system utilizes a static joint to aid in retaining the uniform (or other exterior clothing) in place during vigorous activity. A shirt can be tucked in and retained by the static joint while an extension exits from the pants to provide support to an equipment belt. Various embodiments include modifications to accommodate a wide range of uses and environments, such as those encountered by police, military personnel, electricians, maintenance personnel, security personnel, etc.

BRIEF DESCRIPTION OF THE DRAWINGS

The disclosed inventions will be described with reference to the accompanying drawings, which show important sample embodiments of the invention and which are incorporated in the specification hereof by reference, wherein.

DETAILED DESCRIPTION OF THE PREFERRED EMBODIMENTS

The numerous innovative teachings of the present application will be described with particular reference to the presently preferred embodiment (by way of example, and not of limitation).

Figure 1:
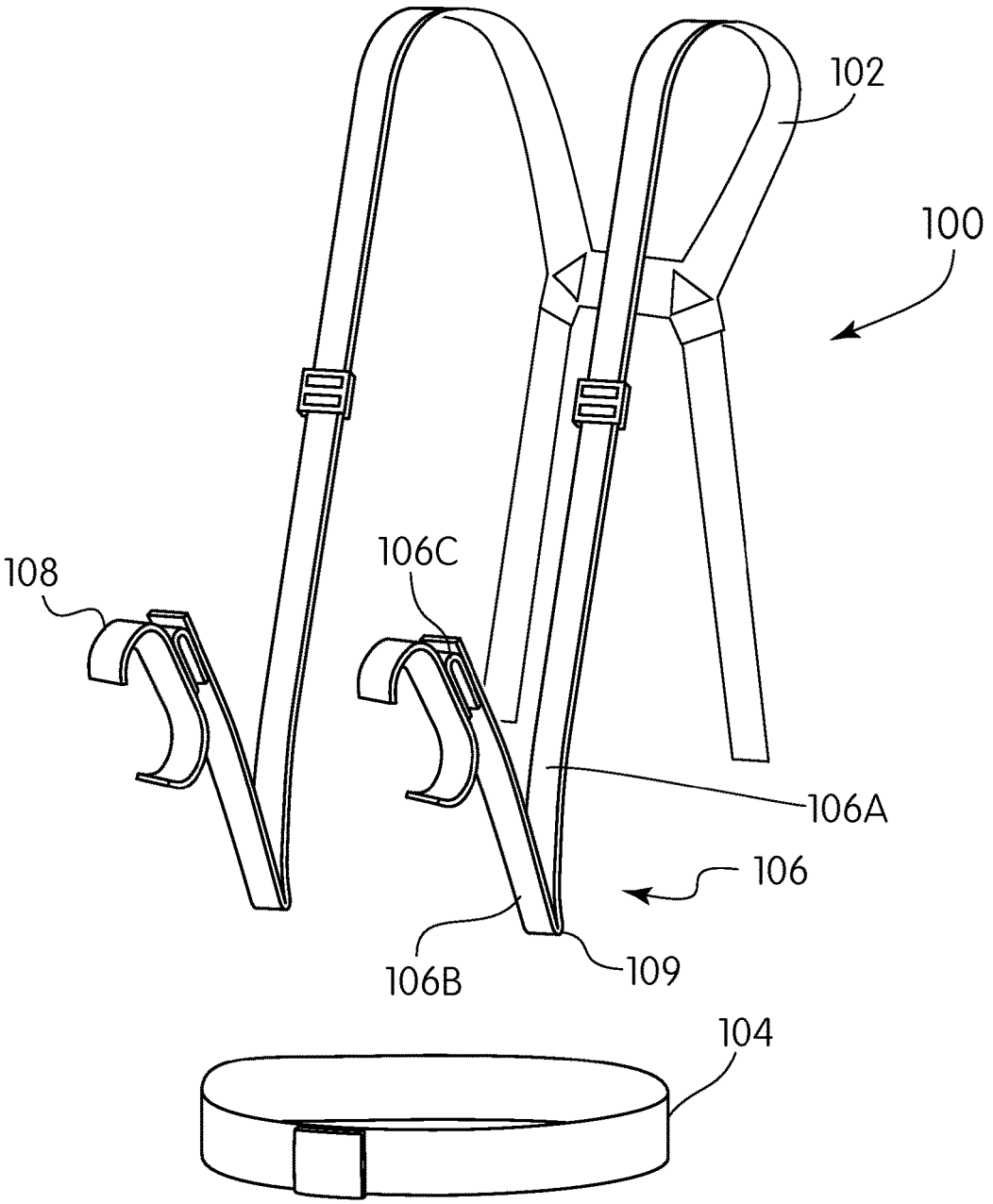
FIG. 1 shows an example embodiment of a support harness and attachments consistent with the present innovations.

FIG. 1 shows an example context consistent with the present innovations. In this example embodiment, support system 100 includes a harness 102 (or alternately other suspension units, such as a cloth undershirt, mesh undershirt, vest, flak jacket or Kevlar protective garment) and an equipment belt 104. Equipment belt 104 is attached to harness 102 with attachments 106. In this example, attachments 106 include open faced belt keepers 108 for fixing the attachments 106 to the equipment belt 104, such as a generally C-shaped rigid plastic or metal bracket. The open face belt keepers 108 are sized so that a semi-flexible equipment belt 104 can be received by the belt keepers 108 either by being inserted into place through the opening in the front or slid into place from the side.

The attachments 106 comprise several parts, so that the attachments can be worn beneath clothing and yet attach to the equipment belt 104. In one exemplary embodiment, the attachments 106 includes a downward extension 106A extending well below and beneath the beltline (e.g. the approximate user's waist at waist seam level) on the interior of the clothing, typically a shirt and a pair of pants, then return upward again using an upward extension 106B, for example, beneath the wearer's pants but exterior to the wearer's shirt, if that shirt is worn tucked in. This can comply with uniform standards requiring a uniform shirt tucked into uniform pants, or in some situations, a uniform skirt or even a ceremonial kilt.

In this exemplary embodiment, downward extension 106A and upward extension 106B form a static joint 109, for example, that holds a tucked in shirt in place. The top of upward extension 106B is preferably connected to a hook 106C, which is carried over the top seam of the wearer's pants and in some embodiments rigid. Hook 106C is, in some preferred embodiments, connected to belt keepers 108 that attach to the equipment belt 104.

Attachment 106 can be used in many contexts. In one example embodiment, attachment 106 connects (such as by buckles, straps, loops, knots, Velcro®, snaps, or other means) to a harness 102 that preferably extends over the wearer's shoulders, to aid in redistributing the weight of the equipment belt 104 from the hips to the shoulders, for example. In some embodiments, the harness 102 and attachment 106 can essentially be a contiguous nylon (or other synthetic fabric) or leather assembly with an attached upward extension 106B. The harness 102 can be worn under the exterior of a vest, flak jacket, or other clothing or protective garment. Rather than attached to a harness 102, the attachment 106 can be attached directly to a vest, flak jacket, or other clothing or protective garment. It is noted that, since the harness 102 is worn beneath the clothing, but because attachment 106 extends beneath the beltline and provides the static joint, clothing can be worn over the harness and tucked into the belt or pants, and yet the harness still provides support to the equipment belt, which is of course worn on the exterior.

In other embodiments, further attachments 106 are provided to the system. In one example, the harness 102 has four downward depending legs (two in front, two in the rear), and each of these legs includes an attachments 106, so that an equipment belt is supported in four places. In some preferred embodiments, the attachments 106 can be positioned anywhere around the beltline, such as in front, on the sides, or in the rear, or some combination of these. Other variations and configurations are of course possible, such as two or six legs.

Figure 2:
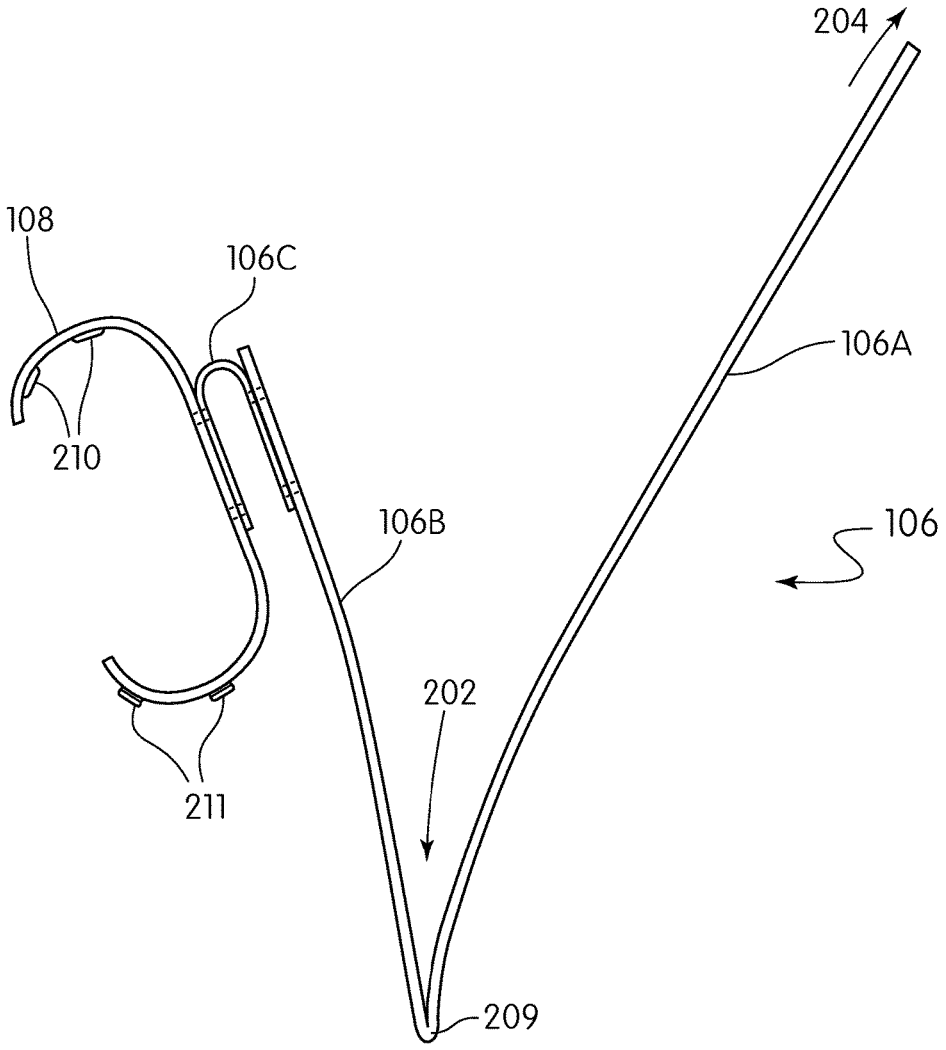
FIG. 2 shows an example embodiment a detail of an attachment consistent with the present innovations.

The attachments described above are further detailed, on one embodiment, in FIG. 2. Attachment 106 includes downward extension 106A, upward extension 106B, hook 106C, and belt keepers 108 for attaching to an equipment belt (not shown). In preferred embodiments, downward and upward extensions 106A, 106B, are flexible or semi-rigid (such as from a thin piece of metal or plastic), but can less preferably be made rigid (as in a thick piece of metal or hard plastic) or non-rigid and semi-flexible (as from reinforced or multi-layered synthetic fabric). Preferred extensions 106A, 106B include interior plastic, metal, or other rigid, semi-rigid, or semi-flexible material that preferably is not elastic along its length, but which is malleable and retains memory. Preferred extensions 106A, 106B provide at the lower end of the downward extension 106A a static joint 209 at the attachment with the upward extension 106B, where they form a joining area 202, for example, to hold between them a shirt tail or other clothing that is tucked in. It is noted that in this example, upper end 204 of downward extension 106A connects to a harness or vest or other support system (not shown).

In use, the belt keeper 108 preferably attaches to an equipment belt. As already noted, the belt keepers 108 can be an open faced rigid structure, but other constructs are available. Belt keepers 108 can be leather, semi-flexible plastic, or a synthetic loop or cuff fastened using male and female snaps, Velcro® closure, or even buckles. Female snaps 210 and male snaps 211 on the belt keeper 108 fasten to secure an equipment belt. Hook 106C preferably hangs over the upper seam of the wearer's pants, so that one side of the hook is outside the pants (beneath the equipment belt), while the other side of the hook extends downward inside the pants. The hook 106C can be flexible (e.g. reinforced synthetic fiber, plastic, or leather), semi-rigid, or rigid.

Upward extension 106B is preferably worn inside the pants, but outside of a shirt tail that is also tucked in the pants. Downward extension 106A is preferably located inside the pants, and also inside of the wearer's shirt, positioned out of sight underneath clothing. Thus joining area 202 preferably holds the shirt tail between the two extensions, sandwiching the shirt tail between them. It is also noted that the extensions 106A, 106B are preferably semi-flexible (but not entirely rigid or non-rigid), so that when the wearer bends over or sits down, elements within the extensions bend with the user's body and return to their original straightness when the user resumes a standing position. However, it is important for joining area 202 to maintain sufficient structural rigidity for the system to support an equipment belt without being straightened and pulled out of position. In preferred embodiments, downward extension 106A can be longer than upward extension 106B or equal in length.

In this way, the attachments can be used to connect the exterior equipment belt to the interior harness, which can be worn as part of a flak jacket or vest, or which can be worn simply as a harness (such as from webbing or other material), whether attached to a vest, worn alone, or even potentially worn under a vest.

Figure 3:
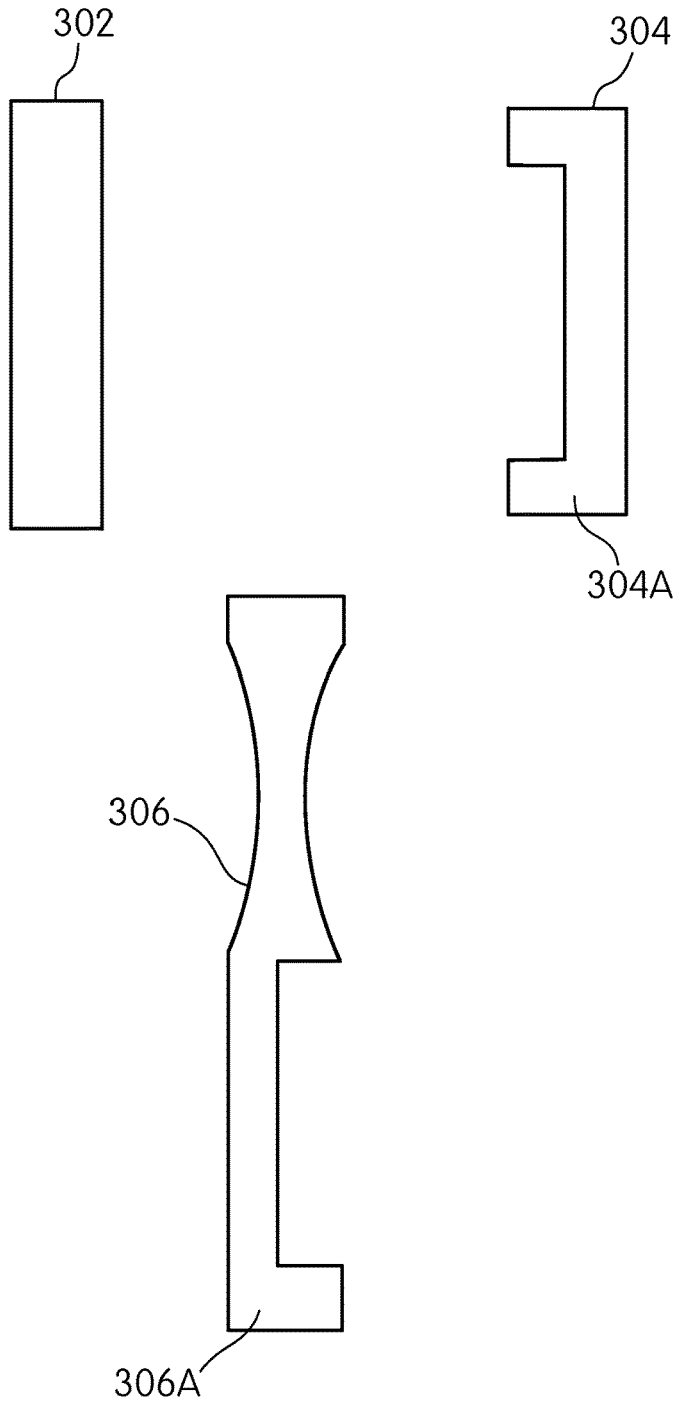
FIG. 3 shows an example embodiment of reinforcements consistent with the present innovations.

FIG. 3 shows examples of the stiffening elements that are preferably part of extensions 106A, 106B. In this example, stiffening elements can be rectangular 302, or have cutouts 304, 306. In preferred embodiments, two elements such as elements 304, 306, are used together and overlap such that they are attached at their bottom ends (304A and 306A) to provide full width surface to attach them (and preferably create a static joint). Because they can (but do not necessarily) include opposing cutouts, they offer combined stiffness against twisting, and provide a "full width" profile when overlapped, but are more individually flexible when bent such as when the wearer sits or bends over. This enhances comfort of use. Preferred embodiments include elements that include no sharp corners, and use curves such as the hourglass shape, or other shapes, as shown in the upper part of element 306.

Figure 4:
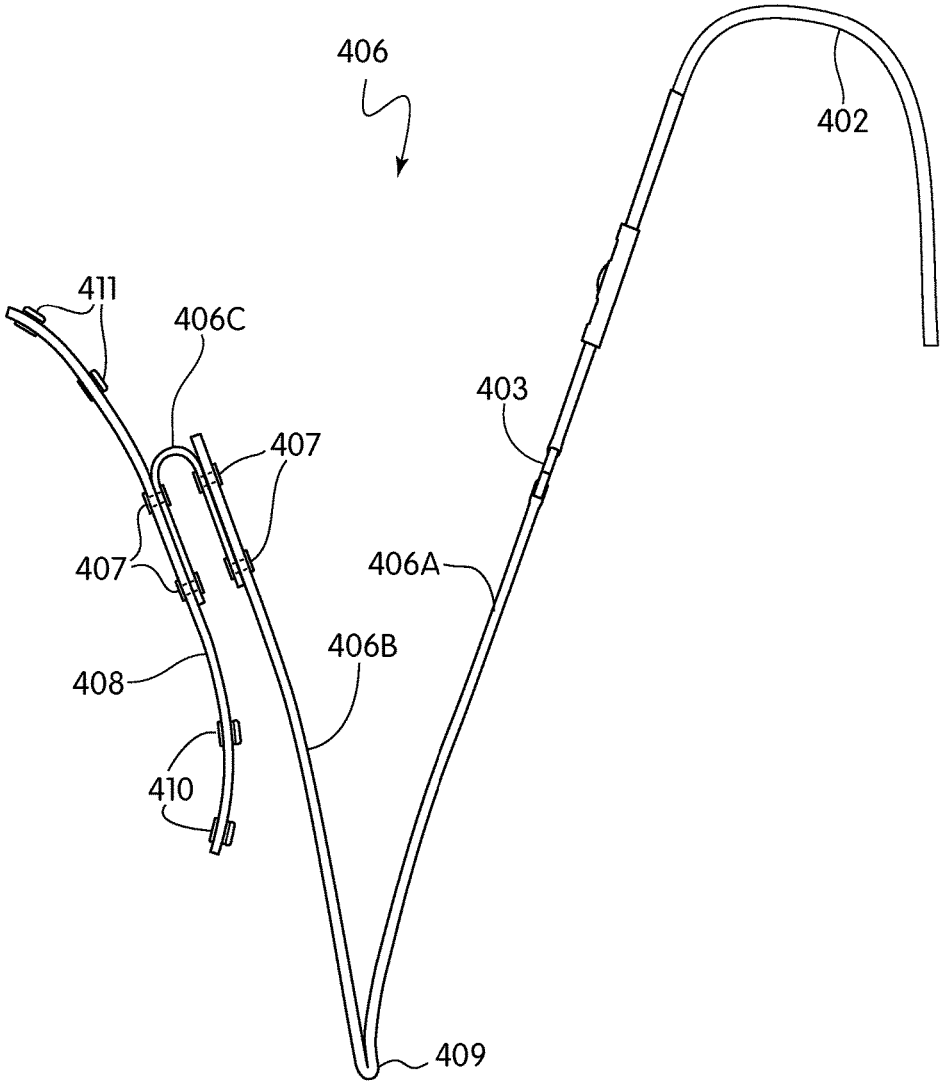
FIGS. 4 and 4A show a side and top view of an embodiment of the attachments consistent with the present innovations.
Figure 4A:
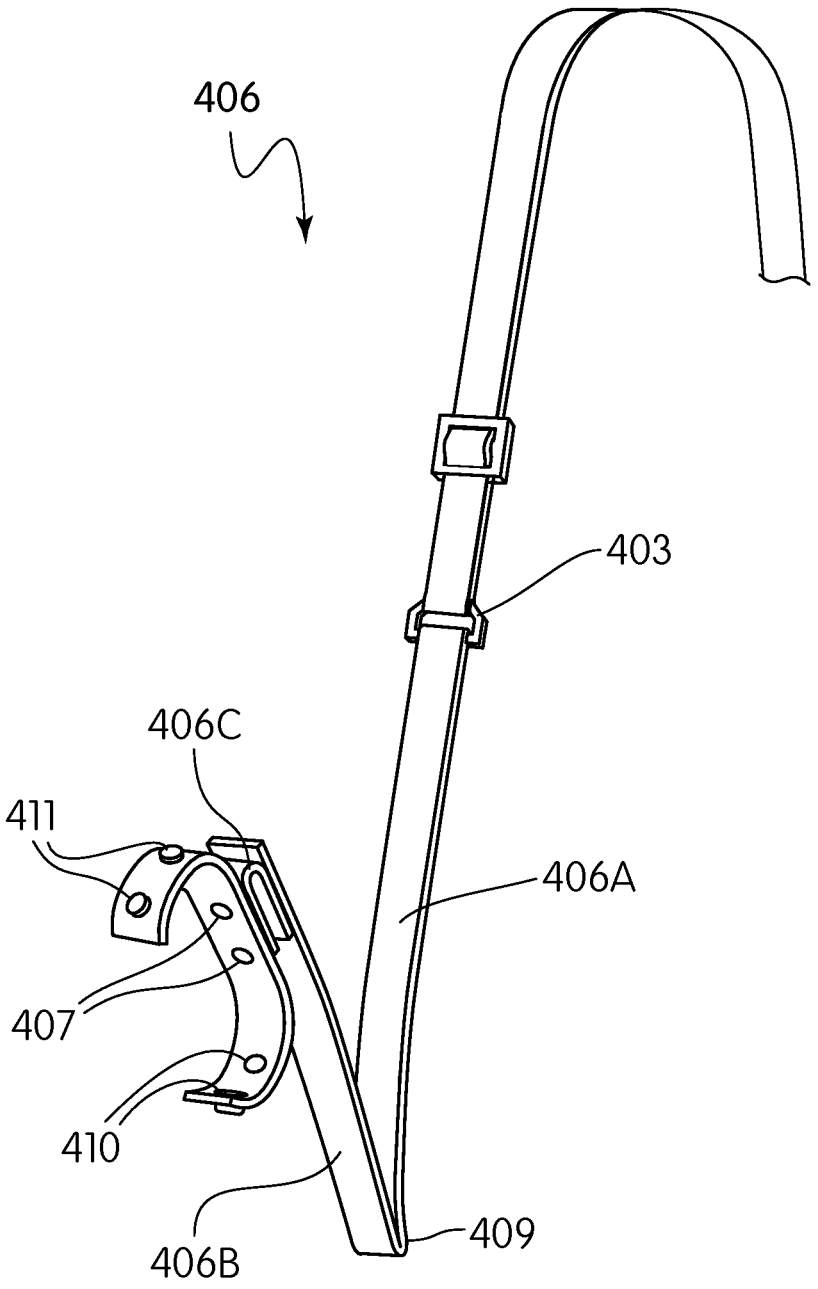

FIGS. 4 and 4A show a side and top view of an embodiment of the attachments 406. The downward extension 406A can be attached to the harness 402 by a buckle 403 to which the harness 402 can adjustably be attached. The downward extension 406A and upward extension 406B in this embodiment is one piece, constructed from two layers of synthetic fabric sandwiching a semi-rigid length of U-shaped thin metal or plastic sewn in between the two layers, with the U-shape static joint 409 providing the transition of the downward extension 406A to the upward extension 406B. Another method of construction is to have the downward extension 406A and upward extension 406B constructed of reinforced synthetic fabric with a metal or plastic member sewn or adhesively sealed within, forming an acute angled U-shape, V-shape, or J-shape static joint 409. The hook 406C can be a bare length of U-shaped metal, with one end attached to the end of the upward extension 406B using rivets 407. The other end of the hook 406C can be attached to the middle of a belt keeper 408 also using rivets 407. The hook 406C can be made of a length of leather or plastic or other material, with male snap fasteners 411 and female snap fasteners 410 on either end designed to snap over the width of a supported equipment belt.

Figure 5:
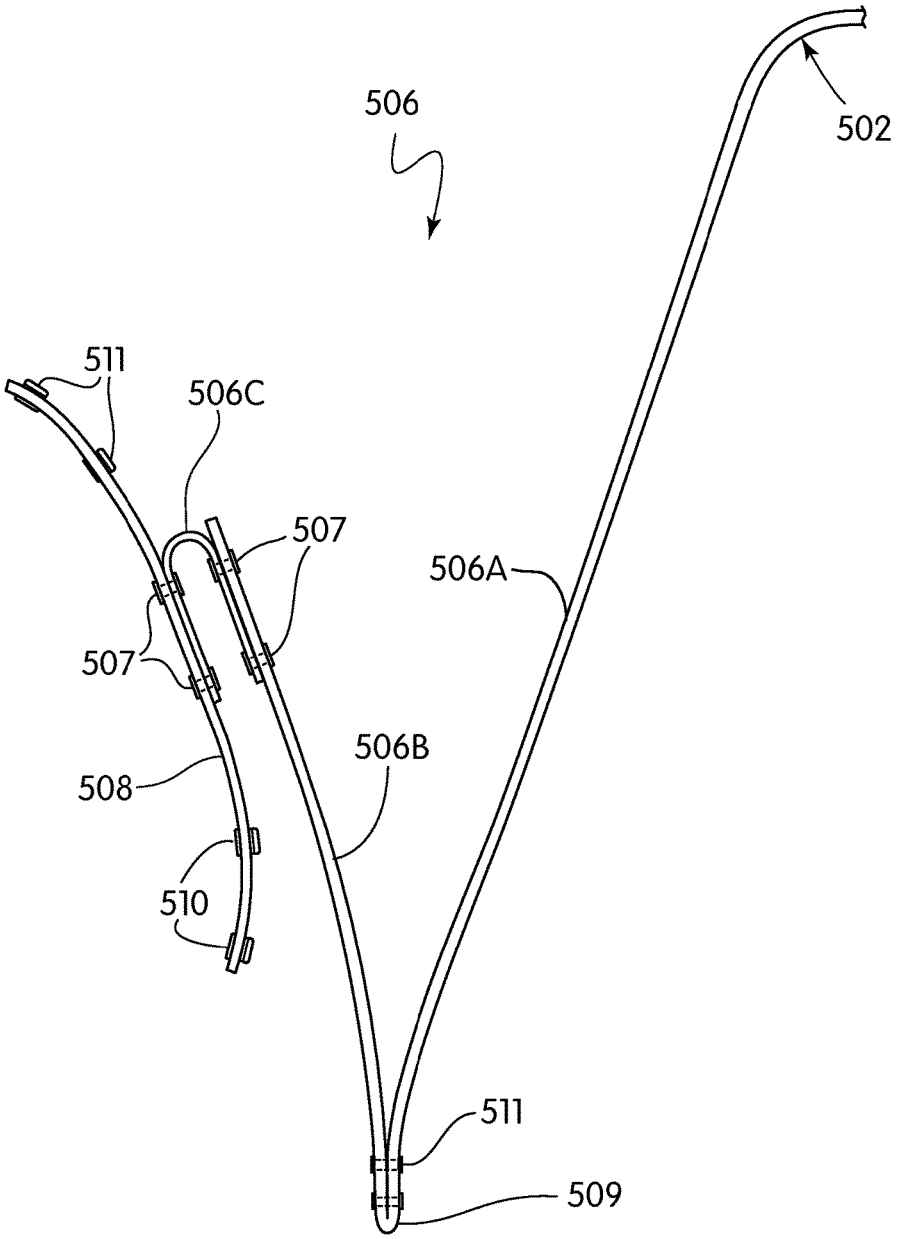
FIGS. 5 and 5A show another side and top view of an embodiment of the attachments consistent with the present innovations.
Figure 5A:
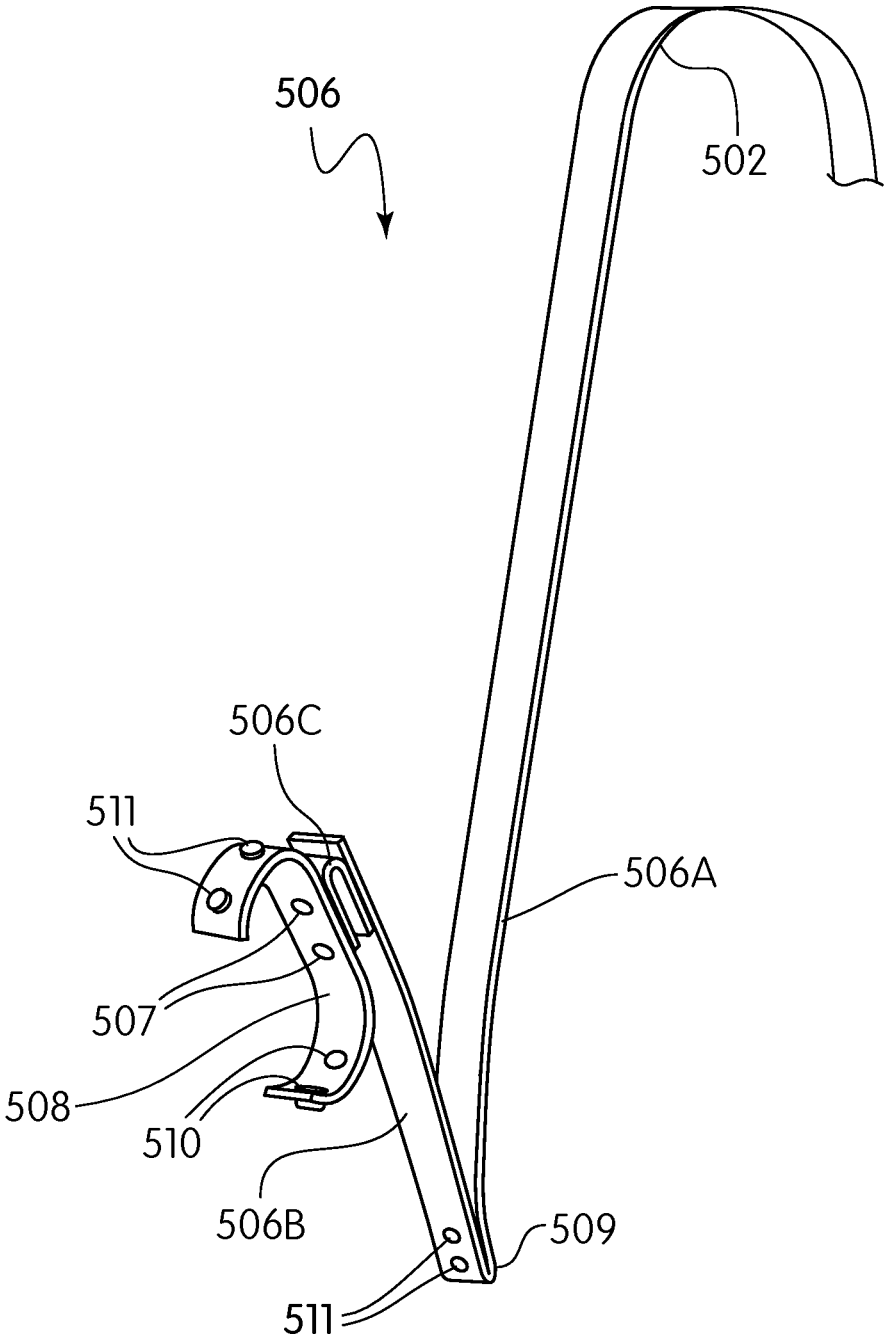

FIGS. 5 and 5A show a side and top view of another embodiment of the attachments 506. In this embodiment, the downward extension 506A is an integrated extension of the harness 502, which can be formed by reinforcing the end of the harness 502. The reinforcing can be done with multiple synthetic fabric layers, by adding an adhesive stiffener, or by using a thin length of semi-flexible plastic or sheet metal sewn between layers of fabric. The upward extension 506B is a separately formed structure also constructed using multiple synthetic fabric layers or by using a thin length of semi-flexible plastic or sheet metal sewn between layers of synthetic fabric attached with fasteners 511 to the end of the downward extension 506A. The two attached ends form an acute angled V-shaped static joint 509.

In this embodiment, a loop area 506C loops over the top seam of pants and is formed by attaching another reinforced, semi-flexible synthetic fabric extension at the end of the upward extension 506B, to extend back downward and connect with the equipment belt. The belt keeper 508 in this embodiment is a length of semi-flexible, reinforced synthetic fabric, with male snap fasteners 511 and female snap fasteners 510 on either end designed to snap over the width of a supported equipment belt.

Figure 6:
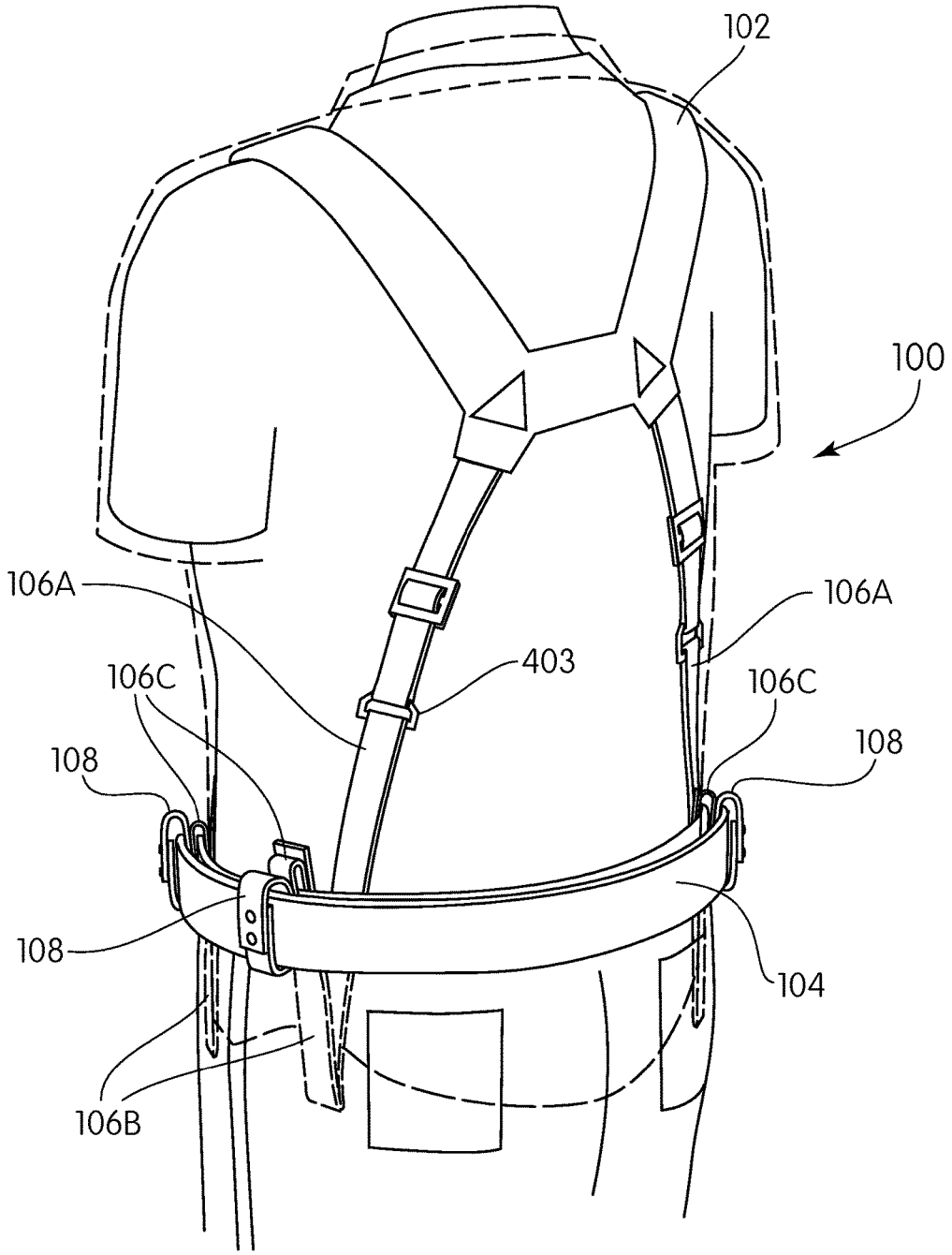
FIG. 6 shows a perspective rear view of an embodiment of the suspension system consistent with the present innovations.

FIG. 6 provides a rear perspective view of the suspension system underneath a cut away view of a shirt. The suspension system 100 includes the harness 102. The downward extensions 106A are fastened to the harness 102 by a buckle 403. The semi-rigid downward extension 106A transitions to a semi-rigid upward extension 106B underneath clothing, so that the downward extension 106A is positioned underneath a shirt and trousers and the upward extensions 106B is positioned above the shirt and underneath the trousers, sandwiching the shirt between the downward extension 106A and upward extension 106B. A hook 106C loops over the top of trouser seam to outside the trousers to position the equipment belt 104 inside the fastened belt keepers 108. As readily apparent from the figure, the weight of the equipment belt 104 is at least partially transferred to the harness 102.

Of course, the innovations of the present application are not limited to the embodiments disclosed, but can include various materials, configurations, positions, or other modifications beyond these embodiments shown, which are exemplary only.

The present innovations include various embodiments that can provide a range of advantages to users, including (but not limited to) alleviating back pain, hip bruising, knee problems, and fatigue. The present innovations also provide improved ability to function in some conditions, such as while running, grappling, jumping, or other vigorous activity where an equipment belt is worn. In general terms, the innovations presented herein offer improved wearability of loads in the hip region without the need to use the hands to hold the equipment belt in place and prevent it from moving up and down.

According to a disclosed class of innovative embodiments, there is provided: a concealed supplemental support system for an equipment belt, comprising a suspension unit for fitting over a wearer body underneath clothing; a downward extension coupled to the suspension unit extending below and beneath the beltline on the interior of the wearer's clothing, with a lower end forming an acute angled static joint with a connected upward extension, and an upper end attached to the suspension unit; the upward extension extending up from the static joint connection to the lower end of the downward extension, with a joining area formed between the upward and the downward extension able to accommodate wearer clothing with interior and exterior sides of the clothing sandwiched between the downward extension and the upward extension, the upward extension extending from the interior just above the beltline over a seam to connect to a belt keeper; and said belt keeper capable of securing an equipment belt so as to be at least partially supported by the suspension unit, wherein the downward extension and the upward extension resist straightening out of position.

According to a disclosed class of innovative embodiments, there is provided: a method for supporting an equipment belt using a concealed suspension, comprising the steps of providing a suspension unit worn on a user coupled to a downward extension; extending the downward extension underneath the user's clothing below the beltline that ends and transitions to an upward extension, the upward extension extending up from the downward extension, with a joining area formed by a static joint between the upward and the downward extension able to accommodate an item of wearer clothing sandwiched between the downward extension and the upward extension, the upward extension extending upward from the interior over an exterior seam at approximately the user's waist to connect to a belt keeper, the combined structure of the downward extension and upper extension exhibiting at least semi-flexibility to resist straightening and bending under a load; and securing an equipment belt to the upward extension so as to be at least partially supported by the suspension unit.

According to a disclosed class of innovative embodiments, there is provided: a support system worn beneath clothing for an equipment belt, comprising a downward extension, extending below the waistline of an user and beneath the user's clothing, with a lower end joined to an upward extension; the upward extension extending up from the downward extension lower end, joined to the downward extension by a static joint, forming a joining area between the upward extension and the downward extension able to sandwich at least one item of user clothing, the upward extension extending to the approximate waistline of the wearer to above a clothing seam to couple to an equipment belt; wherein the downward extension and upper extension exhibit at least semi-flexibility to resist being deformed and straightened under the load of the equipment belt, transferring at least a portion of said load off of the hip area of the user.

Modifications and Variations

As will be recognized by those skilled in the art, the innovative concepts described in the present application can be modified and varied over a tremendous range of applications, and accordingly the scope of patented subject matter is not limited by any of the specific exemplary teachings given.

For example, in one embodiment, the support structure is a pair of suspenders attached to and worn either beneath or outside the protective vest. For another example, the innovations described herein can be created from a variety of materials, including (but not limited to) hard plastic, sheet metal, Kevlar, webbing, nylon, leather, and other materials, for both the stiffening elements and cover material. These elements can be bound together in various ways, including rivets, glue, stables, and other bonding means. The specific implementations given herein are not intended to limit the practice of the present innovations.

None of the description in the present application should be read as implying that any particular element, step, or function is an essential element which must be included in the claim scope: THE SCOPE OF PATENTED SUBJECT MATTER IS DEFINED ONLY BY THE ALLOWED CLAIMS. Moreover, none of these claims are intended to invoke paragraph six of 35 USC section 112 unless the exact words "means for" are followed by a participle.

The claims as filed are intended to be as comprehensive as possible, and NO subject matter is intentionally relinquished, dedicated, or abandoned.

What is claimed is:

1. A concealed supplemental support system for an equipment belt, comprising:

a suspension unit for fitting over a wearer's body underneath clothing;

a downward extension coupled to the suspension unit extending below and beneath a beltline on the interior of the wearer's clothing, with a lower end forming an acute angled static joint with a connected upward extension, and an upper end attached to the suspension unit;

the upward extension extending up from the static joint connection to the lower end of the downward extension, with a joining area formed between the upward and the downward extensions able to accommodate wearer clothing with interior and exterior sides of the clothing sandwiched between the downward extension and the upward extension, the upward extension extending above the beltline over a seam to connect to a belt keeper; and said belt keeper capable of securing an equipment belt so as to be at least partially supported by the suspension unit, wherein the downward extension and the upward extension resist straightening out of position;

wherein said belt keeper includes a closure which closes completely around the equipment belt to secure it in place, and also opens to release the equipment belt which has been secured in place;

a suspension unit that includes a suspender harness adjustably attached to the downward extension using a fastener.

2. The support system of claim 1, wherein the downward extension and the upward extension are constructed from at least two layers of a material as an integrated structure, with the joining area formed by the static joint comprising an acute angled connection.

3. The support system of claim 1, wherein the downward extension and the upward extension are constructed from material layers as separate structures, with the two separate structures fastened together at the static joint to form the joining area.

4. The support system of claim 1, wherein the downward extension and the upward extension are joined using a fastener at the static joint to form the joining area between the two.

5. The support system of claim 1, wherein the downward extension and the upward extension are two separate structures fastened together at a static joint to form the joining area.

6. The support system of claim 1, wherein the belt keeper comprises a hook looping over an approximate waistline of clothing.

7. The support system of claim 1, wherein the belt keeper comprises a length of at least semi-flexible material, with fasteners on either end designed to bend and fasten over the width of a supported equipment belt.

8. A support system, wearable beneath clothing for supporting an equipment belt, comprising:

a downward extension, extending below a waistline of a user and beneath the user's clothing, with a lower end joined to an upward extension;

the upward extension extending up from the downward extension lower end, joined to the downward extension by a static joint, forming a joining area between the upward extension and the downward extension able to sandwich at least one item of user clothing, the upward extension extending to the approximate waistline of the user to above a clothing seam to a belt keeper wherein said belt keeper includes a closure which closes completely around the equipment belt to secure it in place, and also opens to release the equipment belt which has been secured in place;

wherein the downward extension and upper extension exhibit at least semi-flexibility to resist being deformed and straightened under the load of the equipment belt, thereby transferring at least a portion of said load off of the hip area of the user;

a suspension unit that includes a suspender harness adjustably attached to the downward extension using a fastener.

9. The system of claim 8, wherein the downward extension and the upward extension are constructed as an integrated structure, with the joining area formed by the static joint comprising an acute angled connection, and at least semi-rigid material positioned between two layers.

10. The system of claim 8, wherein the downward extension and the upward extension are two separate structures fastened together at an acute angle at a static joint to form the joining area.

11. The system of claim 1, comprising four of said belt keepers which can attach to the equipment belt in four different places simultaneously.

12. The system of claim 8, comprising four of said belt keepers which can attach to the equipment belt in four different places simultaneously.

13. The system of claim 1, comprising four of said belt keepers all able to attach to the equipment belt in four different places simultaneously; each of said belt keepers being supported by a respective upward extension.

14. The system of claim 8, comprising four of said belt keepers which can attach to the equipment belt in four different places simultaneously; each of said belt keepers being supported by a respective upward extension.

* * * * *